US007641439B2

(12) United States Patent
Chen et al.

(10) Patent No.: US 7,641,439 B2
(45) Date of Patent: Jan. 5, 2010

(54) FLOW PASSAGE STRUCTURE FOR REFRIGERANT COMPRESSOR

(75) Inventors: Jiing Fu Chen, Hsinchu Hsien (TW); Chung-Ping Chiang, Hsinchu Hsien (TW); Yung-Lo Chow, Hsinchu Hsien (TW); Cheng-Chung Yen, Hsinchu Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 585 days.

(21) Appl. No.: 11/507,009

(22) Filed: Aug. 21, 2006

(65) Prior Publication Data

US 2007/0140889 A1 Jun. 21, 2007

(30) Foreign Application Priority Data

Dec. 15, 2005 (TW) ..... 94144407 A

(51) Int. Cl.
*F04D 17/12* (2006.01)
*F25B 31/00* (2006.01)

(52) U.S. Cl. ..... 415/116

(58) Field of Classification Search ..... 415/116, 415/117; 62/510

See application file for complete search history.

(56) References Cited

U.S. PATENT DOCUMENTS 2,280,845 A * 4/1942 Parker ..... 417/53
3,390,545 A * 7/1968 Hoffman ..... 62/510
4,224,010 A * 9/1980 Fujino ..... 415/199.2
6,883,341 B1 * 4/2005 Lifson ..... 62/196.4

* cited by examiner

*Primary Examiner*—Edward Look
*Assistant Examiner*—Nathaniel Wiehe
(74) *Attorney, Agent, or Firm*—Rabin & Berdo, P.C.

(57) ABSTRACT

A flow passage structure can be disposed in a multi-stage centrifugal refrigerant compressor having a deswirl vane and a return channel bend. The flow passage structure includes a two-way flow passage having a first outlet and a second outlet, for diverging externally injected refrigerant; a first side discharge flow passage connected to the first outlet of the two-way flow passage and having a first side outlet disposed below the deswirl vane, such that the diverged refrigerant can be discharged into the return channel bend and uniformly mixed with the refrigerant in the return channel bend; and a second side discharge flow passage connected to the second outlet of the two-way flow passage and having a second side outlet disposed below the deswirl, vane, such that the diverged refrigerant can be injected into the return channel bend and uniformly mixed with the refrigerant in the return channel bend.

20 Claims, 3 Drawing Sheets

FLOW PASSAGE STRUCTURE FOR REFRIGERANT COMPRESSOR

BACKGROUND OF THE INVENTION

1. Field of the Invention

The present invention relates generally to flow passage structures for refrigerant compressors, and more particularly, to a flow passage structure that can be used in inter-stage pressure refrigerant injection for a multi-stage centrifugal refrigerant compressor.

2. Description of Related Art

Centrifugal chillers generally comprise centrifugal refrigerant compressors for compressing refrigerant. In practice, for purpose of enhancing refrigeration cycle performance and cooling capability, centrifugal refrigerant compressors having two or more stages are utilized, thereby increasing energy efficiency of centrifugal chillers.

Such a multi-stage centrifugal refrigerant compressor is generally provided with an economizer cycle. Therein, an economizer is used to reduce liquid refrigerant to liquid saturated pressure and flash off a portion of the refrigerant of inter-stage pressure. The flashed off refrigerant is then mixed with the main-flow refrigerant for next stage compressing. The above process can reduce power consumption of the centrifugal refrigerant compressor and enhance cooling capability per unit of refrigerant. Therefore, multi-stage centrifugal refrigerant compressors have become an only choice for large-scale central air conditioning systems. Along with application of different kinds of refrigerant, high to low pressure ratios during operation of the compressor can be slightly different. Accordingly, there have appeared centrifugal refrigerant compressors having two Stages, three stages or even more stages.

FIG. 1 is a sectional view of a conventional two-stage centrifugal refrigerant compressor. As shown in FIG. 1, the centrifugal refrigerant compressor 1 comprises a high-speed cantilever shaft 19 supported by a bearing. A first stage centrifugal compressor impeller 12 and a second stage centrifugal compressor impeller 16 are connected in series to the overhanging cantilever of the high-speed cantilever shaft 19.

In operation, refrigerant enters into the inlet 11 of the compressor 1 in the direction of R1, and passes through the first stage centrifugal compressor impeller 12, the first stage diffusing flow passage 13, the deswirl vane 14, the return channel bend 15, the second stage centrifugal compressor impeller 16, the second stage diffusing flow passage 17, and the volute casing 18 such that the pressure of the refrigerant can be increased. Thereafter, the refrigerant with high pressure is discharged from outlet (not shown) of the compressor. The centrifugal refrigerant compressor 1 further comprises a refrigerant injection port 110. Gaseous inter-stage pressure refrigerant from an economizer can be injected into a flow passage through the refrigerant injection port 110 in the direction of R2. The refrigerant then passes through the flow passage and comes out from the outlet 111 disposed near the deswirl vane 14. Thereby, the refrigerant from economizer is mixed with the refrigerant in the return channel bend 15 and comes into the second stage centrifugal compressor impeller for further compression.

However, if the refrigerant injected in the direction of R2 and the refrigerant from the deswirl vane 14 can't be mixed uniformly, the pressure, temperature and density will be distributed unevenly at each section of the fluid, thereby adversely affecting the angle of the refrigerant coming into the next stage centrifugal compressor impeller and causing incidence angle difference. Thus, aerodynamic efficiency is reduced.

Increasing the length of the main flow passage between the first and second stage centrifugal compressor impellers, and accordingly increasing the length of the cantilever L1 of the high-speed cantilever shaft will be helpful to overcome the above drawback. However, this method not only reduces the rigidity of the high-speed cantilever shaft, but also increases the flow loss. Meanwhile, size of the compressor in the axial direction is increased. Thus, such problems as efficiency loss and high material cost are generated.

All the above problems are directly or indirectly caused by the one-side discharge of the refrigerant through the outlet 111.

Therefore, there is a need to develop a flow passage structure that can prevent the one-side discharge problem so as to increase efficiency of the centrifugal refrigerant compressor.

SUMMARY OF THE INVENTION

Accordingly, an objective of the present invention is to provide a flow passage structure for a refrigerant compressor so as to increase the compression efficiency.

Another objective of the present invention is to provide a flow passage structure for a refrigerant compressor so as to reduce the material cost.

A further objective of the present invention is to provide a flow passage structure for a refrigerant compressor that can mix the refrigerant uniformly.

Still another objective of the present invention is to provide a flow passage structure for a refrigerant compressor that can reduce the length of the high-speed shaft and the volume of the compressor.

A further objective of the present invention is to provide a flow passage structure for a refrigerant compressor that can reduce the length of the flow passage.

Still another objective of the present invention is to provide a flow passage structure for a refrigerant compressor that can increase rigidity of the high-speed shaft.

In order to attain the above and other objectives, a flow passage structure that can be disposed in a multi-stage centrifugal refrigerant compressor having a deswirl vane and a return channel bend is proposed. The flow passage structure comprises: a two-way flow passage having a first outlet and a second outlet for diverging externally injected refrigerant; a first side discharge flow passage connected to the first outlet of the two-way flow passage, the first side discharge flow passage having a first side outlet disposed below the deswirl vane such that the refrigerant diverged from the two-way flow passage can be discharged into the return channel bend and uniformly mixed with the refrigerant in the return channel bend; and a second side discharge flow passage connected to the second outlet of the two-way flow passage, the second side discharge flow passage having a second side outlet disposed below the deswirl vane such that the refrigerant diverged from the two-way flow passage can be injected into the return channel bend and uniformly mixed with the refrigerant in the return channel bend.

Therein, the refrigerant in the two-way flow passage is at inter-stage pressure. The refrigerant in the return channel bend is main-flow refrigerant that has passed through the first stage centrifugal compressor impeller and the deswirl vane of the multi-stage centrifugal compressor. The flow passage structure of the present invention further comprises an induction flow passage connected to the two-way flow passage for introduce the externally injected refrigerant into the two-way flow passage. The induction flow passage can be connected to the two-way flow passage at any angle.

In addition, the first side outlet and the second side outlet can be located below the outlet of the deswirl vane and relatively displaced from each other. The first and second side outlet can be located near outlet of the deswirl vane and between blades of the deswirl vane.

The two-way flow passage structure of the present invention is helpful to uniformly mix the inter-stage pressure refrigerant with the main-flow refrigerant, thereby efficiently decreasing disturbance of the inter-stage pressure refrigerant to the main-flow refrigerant. As a result, the flow loss can be reduced and the compressing efficiency can be increased.

Meanwhile, the present invention can shorten the distance between the outlet of the deswirl vane and the inlet of the next stage impeller so as to reduce the length of the overhanging cantilever of the high-speed shaft and increase the rigidity of the high-speed shaft. Therefore, a short flow passage and short rotation axis are achieved, and the compressor can be designed more compactly and fabricated at low cost.

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification. The present invention can also be performed or applied by other different embodiments. The details of the specification may be on the basis of different points and applications, and numerous modifications and variations can be devised without departing from the spirit of the present invention.

Figure 1:
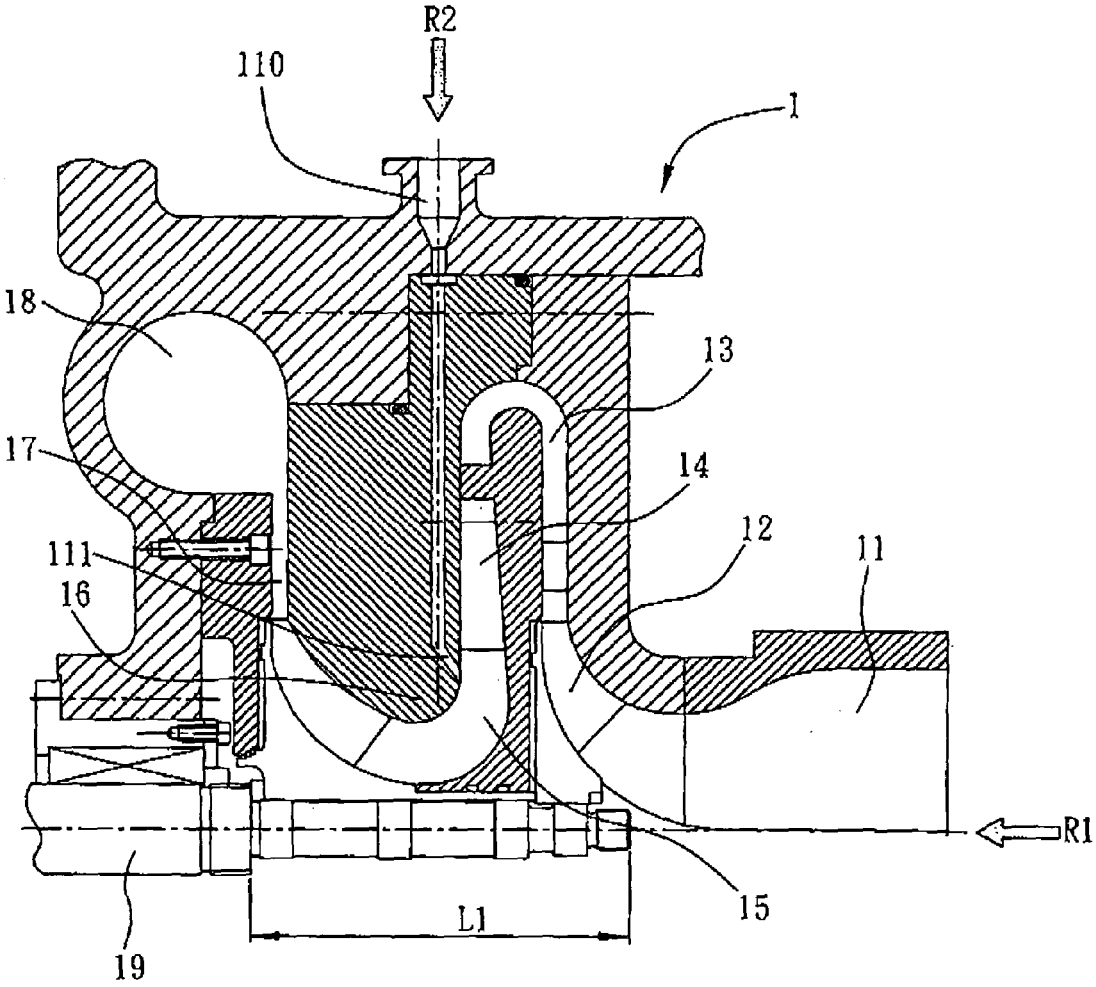
FIG. 1 (PRIOR ART)
FIG. 1 (PRIOR ART) is a sectional view of a conventional multi-stage centrifugal refrigerant compressor.
Figure 2:
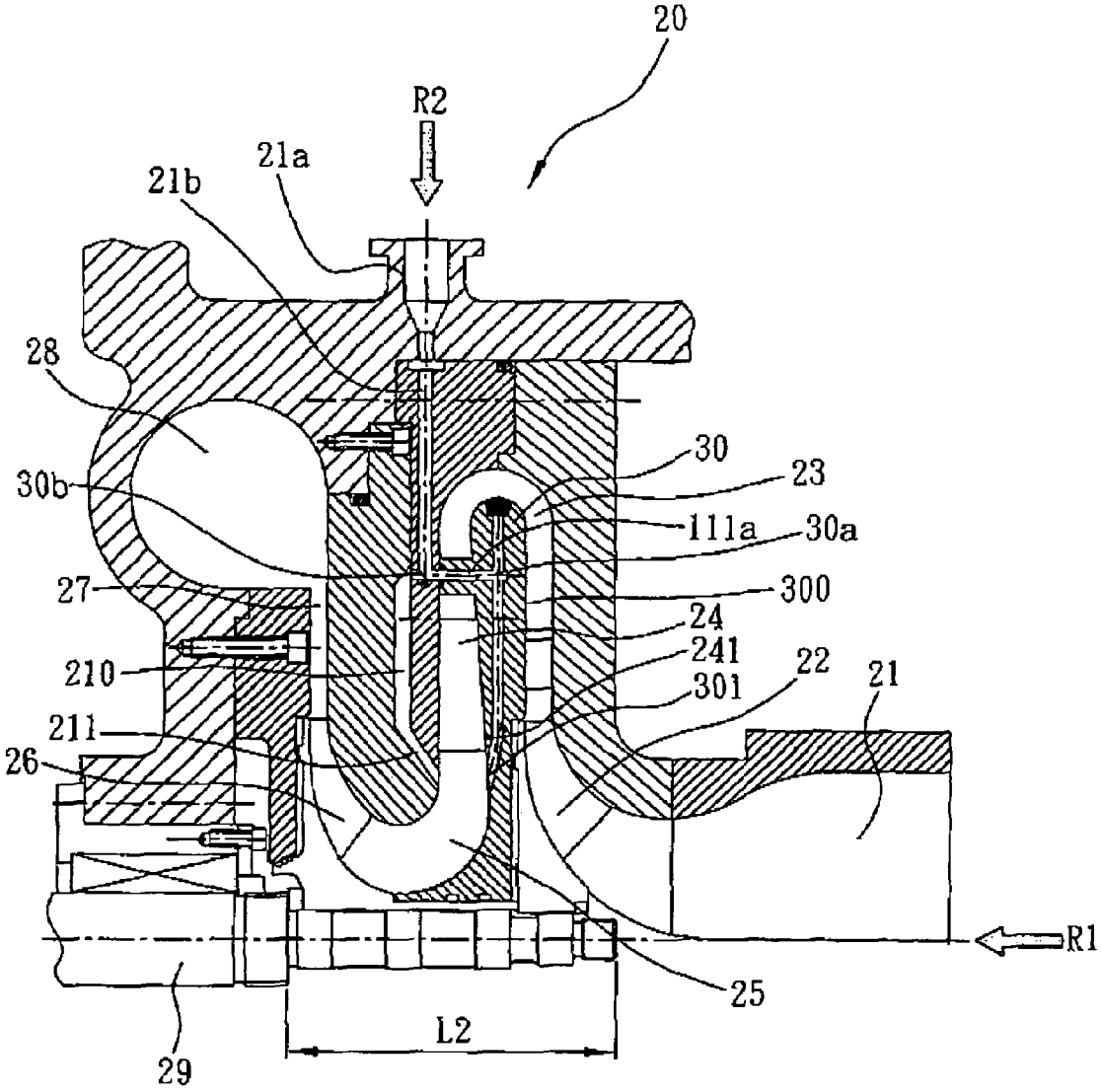
FIG. 2 is a sectional view of a multi-stage centrifugal refrigerant compressor with a flow passage structure of the present invention.

The flow passage structure of the present invention can be disposed in a multi-stage centrifugal refrigerant compressor. In the present embodiment, the flow passage structure is disposed in a two-stage centrifugal refrigerant compressor, as shown in FIG. 2. Similar to a conventional refrigerant compressor, the two-stage centrifugal refrigerant compressor 20 comprises an inlet 21, a first stage centrifugal compressor impeller 22, a first stage diffusing flow passage 23, a deswirl vane 24, a return channel bend 25, a second stage centrifugal compressor impeller 26, a second stage diffusing flow passage 27, a volute casing 28, and a rotation shaft (e.g. a high-speed shaft) 29. Therein, length of the overhanging cantilever L2 of the high-speed shaft 29 is smaller than length of the overhanging cantilever LI of the high-speed shaft in FIG. 1. Meanwhile, the first stage centrifugal compressor impeller 22 and the second stage centrifugal compressor impeller 26 are connected in series to the overhanging cantilever of the high-speed shaft 29.

The present invention is characterized by a two-way flow passage structure, which comprises an induction flow passage 21*b* connected with an inter-stage pressure refrigerant inlet 21*a*, a two-way flow passage 30 connected to the induction flow passage 21*b* and comprising a first outlet 30*a* and a second outlet 30*b* for diverging the inter-stage pressure refrigerant.

The flow passage structure further comprises a first side discharge flow passage 300 connected to the first outlet 30*a* of the two-way flow passage 30 and a second side discharge flow passage 210 connected to the second outlet 30*b* of the two-way flow passage 30. Therein, the first and second side discharge flow passages 300, 210 respectively have a first side outlet 301 and a second side outlet 211 disposed below outlet of the deswirl vane 24 such that the inter-stage pressure refrigerant from the two-way flow passage 30 can be discharged into the return channel bend 25 and uniformly mixed with the main-flow refrigerant in the return channel bend 25. The two-way flow passage 30 is horizontal between the first outlet 30*a* and the second outlet 30*b*. and the first side outlet 301 and the second side outlet 211 are disposed on opposite sides of the return channel bend 25, as illustrated in FIG. 2.

The main-flow refrigerant enters into the inlet 21 of the compressor in the direction of R1, passes through the first stage centrifugal compressor impeller 22, the first stage diffusing flow passage 23, the deswirl vane 24, the return channel bend 25, the second stage centrifugal compressor impeller 26, the second stage diffusing flow passage 27, the volute casing 28, and then discharged at high pressure from outlet (not shown) of the compressor. Meanwhile, the inter-stage pressure refrigerant from the economizer enters into the inlet 21*a* in the direction of R2, passes through the induction flow passage 21*b* and the two-way flow passage 30, and then diverges into the first side discharge flow passage 300 and the second side discharge flow passage 210. Finally, the refrigerant is discharged from the first side outlet 301 and the second side outlet 211, mixingly injected into the return channel bend 25, and mixed with the main-flow refrigerant in the return channel bend 25. The mixed refrigerant then comes into the second stage centrifugal compressor impeller for compression. The two-way flow passage structure of the present invention is helpful to mix the refrigerant uniformly and accordingly increase the compression efficiency.

Figure 3:
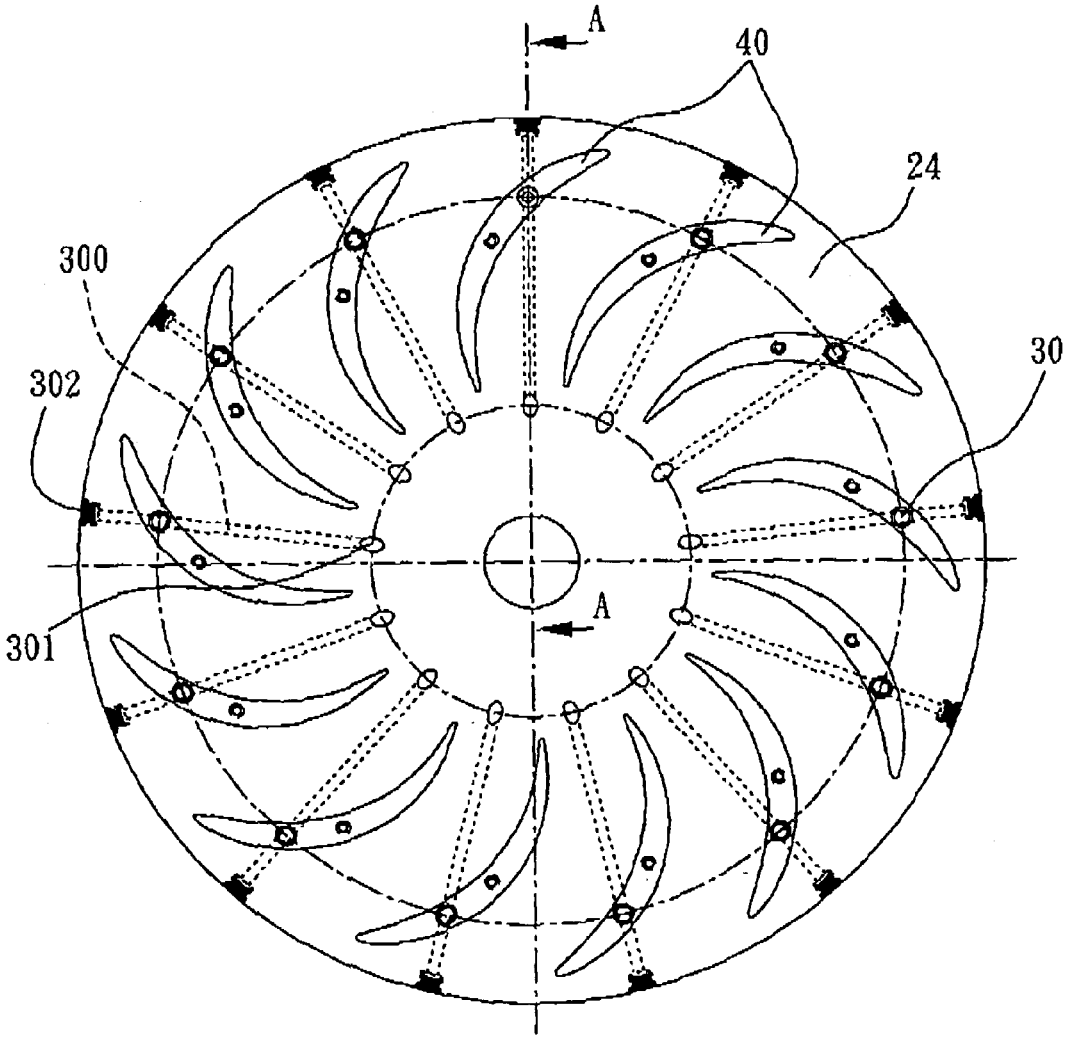
FIG. 3 is a sectional view of the flow passage structure and the deswirl vane according to the present invention.

FIG. 3 is a sectional view of the flow passage structure and the deswirl vane 24. As shown in FIG. 3, the first side outlet 301 is disposed near the outlet of the deswirl vane 24 and between two blades of the deswirl vane 24.

Through the two-way flow passage structure of the present invention, the inter-stage pressure refrigerant can be uniformly mixed with the main-flow refrigerant, thereby efficiently decreasing disturbance of the inter-stage pressure refrigerant to the main-flow refrigerant. Accordingly, the flow loss is reduced and the compressing efficiency is increased.

Meanwhile, the present invention shortens the distance between the outlet of the deswirl vane 24 and the inlet of the next stage impeller 26, which thus reduces the length of the overhanging cantilever 29 of the high-speed shaft and increases the rigidity of the high-speed shaft. Therefore, a short flow passage and short rotation axis are achieved, and the compressor can be designed more compactly and fabricated at low cost.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. A flow passage structure disposed in a multi-stage centrifugal refrigerant compressor having a deswirl vane and a return channel bend, the flow passage structure comprising:

a two-way flow passage having a first outlet and a second outlet, for diverging externally injected refrigerant;

a first side discharge flow passage connected to the first outlet of the two-way flow passage, the first side discharge flow passage having a first side outlet disposed below the deswirl vane such that the refrigerant diverged from the two-way flow passage is allowed to be discharged into the return channel bend and uniformly mixed with the refrigerant in the return channel bend; and a second side discharge flow passage connected to the second outlet of the two-way flow passage, the second side discharge flow passage having a second side outlet disposed below the deswirl vane such that the refrigerant diverged from the two-way flow passage is allowed to be injected into the return channel bend and uniformly mixed with the refrigerant in the return channel bend.

2. The flow passage structure of claim 1, wherein the refrigerant discharged from the first side outlet and the second side outlet is mixingly injected into the return channel bend.

3. The flow passage structure of claim 1, further comprising an induction flow passage connected to the two-way flow passage, for introducing the externally injected refrigerant into the two-way flow passage.

4. The flow passage structure of claim 3, wherein the induction flow passage is connected to an inlet for injection of inter-stage pressure refrigerant.

5. The flow passage structure of claim 3, wherein the induction flow passage is connected to the two-way flow passage at any angle.

6. The flow passage structure of claim 1, wherein the refrigerant in the two-way flow passage is at inter-stage pressure.

7. The flow passage structure of claim 1, wherein the refrigerant in the return channel bend is main-flow refrigerant that has passed through a first stage centrifugal compressor impeller and the deswirl vane of the multi-stage centrifugal compressor.

8. The flow passage structure of claim 7, wherein the main-flow refrigerant enters into the centrifugal refrigerant compressor, passes through the first stage centrifugal compressor impeller, a first stage diffusing flow passage, the deswirl wane, the return channel bend, a second stage centrifugal compressor impeller, a second stage diffusing flow passage, and finally discharges from the centrifugal refrigerant compressor at high pressure.

9. The flow passage structure of claim 8, wherein while passing through the return channel bend, the main-flow refrigerant uniformly mixes with refrigerant from the first and second side outlets.

10. The flow passage structure of claim 1, wherein the first side outlet and the second side outlet are relatively displaced from each other.

11. The flow passage structure of claim 1, wherein the first side outlet is located below an outlet of the deswirl vane.

12. The flow passage structure of claim 1, wherein the second side outlet is located below an outlet of the deswirl vane.

13. The flow passage structure of claim 1, wherein the first side outlet is located near an outlet of the deswirl vane and between blades of the deswirl vane.

14. The flow passage structure of claim 1, wherein the second side outlet is located near an outlet of the deswirl vane and between blades of the deswirl vane.

15. The flow passage structure of claim 1, wherein the two-way flow passage is disposed in horizontal direction.

16. The flow passage structure of claim 1, wherein the multi-stage centrifugal compressor comprises at least two centrifugal compressor impellers and diffusing flow passages.

17. The flow passage structure of claim 1, wherein the multi-stage centrifugal compressor further comprises a volute casing.

18. The flow passage structure of claim 1, wherein the multi-stage centrifugal compressor further comprises a rotating shaft.

19. The flow passage structure of claim 18, wherein at least a first stage centrifugal compressor impeller and a second stage centrifugal compressor impeller are connected in series to an overhanging cantilever of the rotating shaft.

20. The flow passage structure of claim 1, wherein the first and second side outlets are disposed on opposite sides of the return channel bend; and the two-way flow passage is horizontal between the first and second outlets.

* * * * *

UNITED STATES PATENT AND TRADEMARK OFFICE

CERTIFICATE OF CORRECTION

PATENT NO. : 7,641,439 B2
APPLICATION NO. : 11/507009
DATED : January 5, 2010
INVENTOR(S) : Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 722 days.

Signed and Sealed this

Sixteenth Day of November, 2010

David J. Kappos

David J. Kappos
*Director of the United States Patent and Trademark Office*